United States Patent [19]

Jones

[11] 3,934,767

[45] Jan. 27, 1976

[54] TEXTILE PACKAGE OF A CELLULAR PLASTIC CORE WITH WOUND YARN

[75] Inventor: Edward Jones, Clarkes Summit, Pa.

[73] Assignee: Rohm & Haas Company, Philadelphia, Pa.

[22] Filed: Feb. 28, 1973

[21] Appl. No.: 336,651

[52] U.S. Cl. ..... 223/106; 156/172; 206/389; 229/4.5; 242/118.7; 428/35; 428/222; 428/304; 428/310

[51] Int. Cl.[2] ..... B65H 81/00; B65D 85/676; B65H 75/14; B32B 5/18

[58] Field of Search ..... 156/172; 161/47, 159, 39; 206/2, 389; 220/63; 138/103, DIG. 9; 223/106; 242/68.5, 118.2, 118.7; 428/222, 304, 310

[56] References Cited

UNITED STATES PATENTS

| | | | |
|---|---|---|---|
| 2,873,226 | 2/1969 | Davies et al. | 161/39 |
| 2,917,217 | 12/1959 | Sisson | 138/103 |
| 3,179,245 | 4/1965 | Bastian, Jr. | 242/68.5 X |
| 3,207,394 | 9/1965 | Claridge | 242/118.7 X |
| 3,432,116 | 3/1969 | Laven et al. | 242/118.7 |
| 3,567,541 | 3/1971 | Kaczerginski | 156/172 |
| 3,654,050 | 4/1972 | Fraser | 161/47 X |
| 3,666,589 | 5/1972 | Alderfer | 156/172 |

FOREIGN PATENTS OR APPLICATIONS

| | | |
|---|---|---|
| 2,125,761 | 9/1972 | France |

*Primary Examiner*—Philip Dier

[57] ABSTRACT

Comprising filaments, fibers or yarn wound around a deformable hollow cellular plastic core, wherein the wall thickness on the plastic core is such that if the inside diameter of the cellular core is increased by one-sixteenth inch by compression of the cellular plastic, the compressive forces on the inside of the core will not change the outside diameter of the core.

4 Claims, 4 Drawing Figures

POLYSTYRENE NEW TUBE

POLYSTYRENE USED TUBE

TEXTILE PACKAGE OF A CELLULAR PLASTIC CORE WITH WOUND YARN

This invention relates to textile packages comprising filaments, fibers or yarn wound around a deformable hollow cellular plastic core.

Innumerable types of hollow metal and/or paper cores have been used for textile packages. In general, these cores have to be manufactured to close tolerances in order to serve the intended use. For example, insulating yarn used to wrap electric wires is commonly wound on parallel kraft paper tubes, which are slotted, scored, split and waxed.

Tubes for insulating yarn have to be split since in the wire wrapping operaion performed in the customers plant a spare tube is mounted above the spindle to enable the customer to use two packages of yarn before the wire being wrapped must be cut. After the yarn on the first tube is exhausted, the split tube is removed from the spindle without breaking the wire running up through the hollow spindle and through the textile packages. Although the split tube is advantageous in the wire wrapping operation, it complicates the production of textile packages. The tube must be sufficiently thick so that the split ends can be butted together and not deform under the tension employed in the tubing or winding operaion and subsequent storage of the textile package before use. In order to provide this rigidity, it is necessary to wrap the circumference of the split tube with paper tape.

The tubes are usually slotted in order to mate them properly on the spindles used to wind the yarn and subsequently to unwind the yarn. They are also scored in order to seat the yarn properly when the first few hundred feet of yarn are wound on the core. The tubes are often waxed in order to prevent deformation of the tube under high humidity conditions.

As indicated above, these tubes must be manufactured to close tolerance on both the inside and outside diameter of the tubes. Cores that are too tight do not fit on the spindles and if too loose oftentimes result in improperly wound packages. Paper tubes that are of the correct diameter or slightly undersized may fit on a tubing spindle prior to winding but often compress further during storage to the extent that they are difficult or often impractical to position on the hollow spindle in the wire wrapping operation. This is the cause for a significant number of rejects by the customer and results in additional costs in both the yarn processing and wire wrapping operations.

Due to the close tolerance required, it is necessary to check all of the tubes prior to use in the winding operation. Sometimes rejects run as high as 50%. In the case of insulating yarn, where it is common to use fine filament size 1 to 2 denier filaments, the filaments tend to stretch during winding and subsequently shrink during lagging, shipping and storage, putting additional stress on the integrity of the inside diameter of the core.

The object of this invention is to provide a yarn package comprising a tube core that does not need to be held to close tolerance. A further object of this invention is to provide tube cores that do not have to be scored or split prior to use.

I have now found that the objects of this invention can be attained with tube cores comprising an unsplit deformable hollow cellular plastic. The inside diameter of these tubes do not have to be held to close tolerance since with very slight pressure a tube of even 7/16 inch inside diameter will slide onto a ½ inch spindle and can be readily removed when filled with yarn. Since the core is of a foamed plastic material, the plastic readily deforms with slight pressure on the inside surface of the tube but there is no change whatsoever in the dimensions of the outside diameter of the tube, thus leaving the outside diameter intact. If the yarn shrinks during storage, the outside diameter of the core compresses allowing the stresses in the yarn to dissipate without changing the inside diameter of the core, thus leaving the inside diameter intact. This compression also can be used to seat the yarn rigidly on the tube thereby eliminating the need for a scored or embossed tube surface.

The objects and the precise nature of the present invention are made clearer by reference to the attached drawings.

FIG. I is a side elevation of an unused polystyrene textile core of the present invention;

Figure 4:
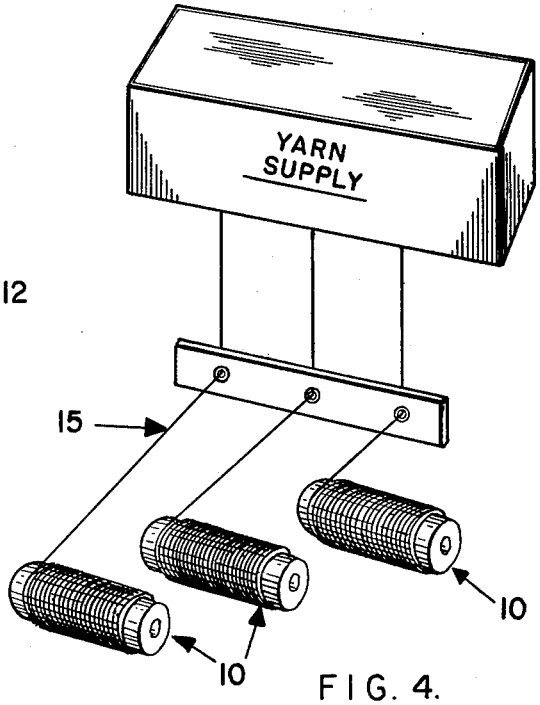

FIG. 4 demonstrates the method of using the textile core.

Figure 1:
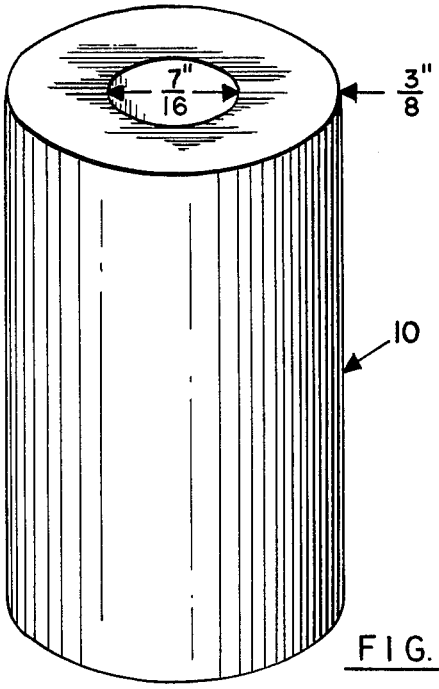
Figure 2:
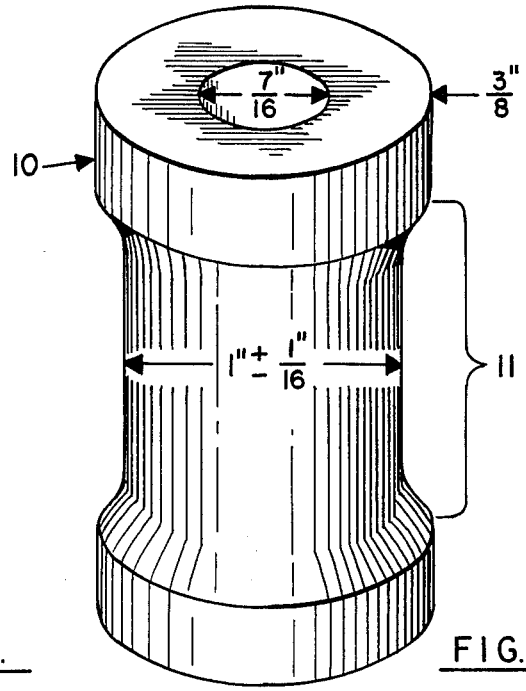
FIG. 2 is the same as FIG. I but it shows the textile core after compressive forces have affected the outside diameter.
Figure 3:
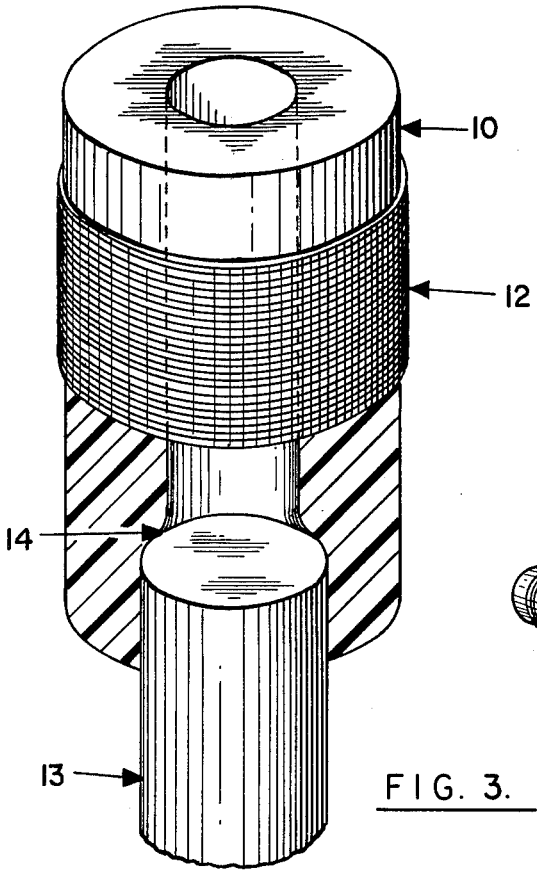
FIG. 3 is a side elevation with a partial cut-away to show how compressive forces affect the inside diameter of the core.

FIG. I shows the structure of the polystyrene textile core 10 as it appears prior to use. The dimensions used in FIG. I and FIG. 2 are only illustrative in nature and are not meant to restrict the core to only those dimensions shown. In FIG. 2, the core 10 is shown after it has been compressed by textile material wrapped about the outside diameter and after the material has been removed. The compressive forces have exerted their effect and left a portion of the core 11 deformed by about 1/16 inch while leaving the inside diameter, in this case 7/16 inch intact due to dissipation of the forces by the core. Likewise, in FIG. 3, where the core 10 is being mounted on a spindle 13 having a diameter larger than the inside diameter of the core, the compressive forces deform the core, such as at point 14, with the core dissipating the forces and leaving the outside diameter of the core and the textile material 12 wound thereabout intact. FIG. 4 shows how a number of cores 10 are used to create textile package. The complete packages are formed in a conventional manner by winding the desired material 15 onto the cores so as to provide a package with the desired amount of textile material.

These tubes have the additional advantage that it is unnecessary to presplit the tube prior to use. Inasmuch as the cellular plastic core is relatively soft, it can be readily cut by a stripping knife or by a hot knife such as a special tipped welding gun. Since the tubes do not have to be split prior to use, they do not have to be taped. Waxing is also unnecessary since these tubes can be manufactured from hydrophobic foamed plastic. In addition, these cores are only a small fraction of the weight of the paper tubes now being used. For example, foamed polystyrene having a density of 2 to 2.5 pounds per cubic foot weighs only about one-nineth the weight of a conventional kraft paper tube now used for insulating wire packages.

Accordingly, the foamed plastic tubes of this invention have the advantage that they do not have to be inspected repeatedly prior to use, they do not have to be embossed or scored, they do not have to be waxed for storage stability, they do not have to be split before use and subsequently taped and they offer savings in shipping costs.

While the cellular hollow cores useful in this invention can be of the same size and shape (conical, tubular, kingspool, etc.) as cores now used for textile packages, these cellular cores are particularly useful for the production of tubular textile insulatng yarn packages discussed above.

In somewhat greater detail, the cellular hollow cores of this invention can be formed from any rigid or semi-rigid cellular plastic, such as polystyrene foam, polyurethane foam, epoxy foam resins, urea-formaldehyde foam resins, polyethylene foam, polyvinyl chloride foam, cellulose acetate foam, etc. Usually the cellular plastic employed will have a density of approximately 1.5 to 10 lbs. per cubic foot. Particularly useful are the cellular polystyrenes sold under the name Styrofoam having a density of 1.5 to 3 pounds per cubic foot.

To some extent the thickness of the cellular plastic wall depends on the rigidity of the plastic foam used. In general, the wall thickness and cellular plastic should be selected in a manner such that if the inside diameter of the cellular plastic is increased by one-sixteenth inch by compression of the cellular plastic or slightly more, the compressive forces on the inside of the core will not deform the outside dimension or change the outside diameter of the core. Likewise, these parameters must be such that any compressive forces on the outside of the cellular core due to winding filaments, yarns or fibers or shrinkage of filaments, etc. during storage of the textile package will not result in deforming or decreasing the inside diameter of the core.

Excellent results have been obtaned with 2 inches long, 1⅛ inch outside diameter tubular cores having cellular styrofoam walls of about ¼ inch to ⅜ inch. Of course, these cellular walls can be thicker, ½ inch or more, and desirably are when larger outside diameter cores are used.

The plastic cellular cores of this invention can be used for fibers, filaments, yarns, etc. of nylon (nylon-6, nylon 6–6, etc.), polyester (polyethylene terephthalate), polyacrylonitrile, polyvinyl alcohol, fiber glass, etc.

The fibers, filaments or yarns can be wound on the hollow cellular plastic core in exactly the same manner as fibers, filaments or yarns are wound on conventinal cores in order to produce textile packages thereby avoiding the problems described above.

Example

A 2 inches long, 1⅛ inch outside diameter, ½ inch inside diameter, 2.5 pounds per cubic foot foamed polystyrene parallel tube is mounted on the take-up spindle of a Foster Tubing machine. Forty denier, 34 filament nylon is wound around the parallel core at 800 to 875 r.p.m. (about 36 to 45 yards per minute ) yielding in about 60 minutes a textile package having a diameter of 2 inches. The textile package can be easily removed from the spindle and re-inserted on the spindle of a yarn dispensing machine even though the package has had its outside diameter decreased by shrinkage of the yarn during storage of the package. Moreover, the initial mounting of the core on the take-up spindle of the Foster Tubing machine does not change the outside diameter of the core although the inside diameter is increased by about one-sixteenth inch.

I claim:

1. A textile package comprising a deformable, hollow, readily splitable cellular plastic core adapted for an interference fit on the spindle of a yarn takeup or yarn dispensing apparatus, and filaments, fibers or yarn wound on said core, said plastic core having a density of about 1.5 to 3 lbs. per cubic foot and a wall thickness of at least about one-fourth inch whereby compression of the inside of the core, causing an increase of one-sixteenth inch in the inside diameter of the core, will not change the outside diameter of the core and compression of the outside of the core by shrinkage of the filaments, fibers or yarns thereon will not decrease the inside diameter of the core.

2. The textile package of claim 1 wherein the plastic is polystyrene.

3. The textile package of claim 1 wherein the wall thickness is about one-fourth to three-eighth inch.

4. The textile package of claim 1 wherein the plastic is polystyrene and the wall thickness is about one-fourth to three-eighth inch.

* * * * *